US008944682B2

(12) United States Patent
Lee

(10) Patent No.: US 8,944,682 B2
(45) Date of Patent: Feb. 3, 2015

(54) CONVERTIBLE CLUTCH PURSE

(75) Inventor: Angela A. Lee, Omaha, NE (US)

(73) Assignee: Uncaged, LLC, Omaha, NE (US)

( * ) Notice: Subject to any disclaimer, the term of this patent is extended or adjusted under 35 U.S.C. 154(b) by 406 days.

(21) Appl. No.: 13/368,523

(22) Filed: Feb. 8, 2012

(65) Prior Publication Data

US 2013/0056118 A1 Mar. 7, 2013

Related U.S. Application Data

(60) Provisional application No. 61/573,315, filed on Sep. 2, 2011, provisional application No. 61/567,473, filed on Dec. 6, 2011.

(51) Int. Cl.

| | |
|---|---|
| ***A45C 9/00*** | (2006.01) |
| ***A45C 3/06*** | (2006.01) |
| ***A45F 4/00*** | (2006.01) |
| ***A45F 3/02*** | (2006.01) |

(52) U.S. Cl.

CPC ... *A45C 3/06* (2013.01); *A45F 4/00* (2013.01); *A45C 9/00* (2013.01); *A45F 3/02* (2013.01); *A45C 2009/007* (2013.01)

USPC ..... 383/4; 224/158; 383/71; 2/91

(58) Field of Classification Search

USPC ..... 224/586, 158, 159; 383/4, 71; 2/91

See application file for complete search history.

(56) References Cited

U.S. PATENT DOCUMENTS

| | | | | | |
|---|---|---|---|---|---|
| 776,193 | A | * | 11/1904 | Mills | 224/602 |
| 2,038,952 | A | * | 4/1936 | Niedorff et al. | 224/218 |
| 2,324,722 | A | * | 7/1943 | Papierniak | 2/93 |
| 2,682,290 | A | * | 6/1954 | Joseph | 383/121 |
| 3,931,917 | A | * | 1/1976 | Zellmer | 224/602 |
| 4,388,739 | A | * | 6/1983 | Martinon et al. | 8/150 |
| 4,404,689 | A | * | 9/1983 | DeWan | 2/247 |
| 4,634,031 | A | | 1/1987 | Frankhouse | |
| 4,667,345 | A | * | 5/1987 | Jachowski | 2/91 |
| D294,195 | S | * | 2/1988 | Starks | D3/246 |
| 4,750,653 | A | | 6/1988 | Prunty | |
| 5,950,887 | A | * | 9/1999 | Powell | 224/158 |
| 6,112,960 | A | | 9/2000 | Seering et al. | |
| D432,299 | S | | 10/2000 | Vazquez | |
| D432,300 | S | * | 10/2000 | Vazquez | D3/232 |

(Continued)

FOREIGN PATENT DOCUMENTS

| | | |
|---|---|---|
| JP | 2009-165598 A | 7/2009 |
| KR | 20-0376077 | 3/2005 |

OTHER PUBLICATIONS

International Search Report and Written Opinion, dated Feb. 1, 2013, from co-owned International Application No. PCT/US2012/053015.

*Primary Examiner* — Tri Mai

(74) *Attorney, Agent, or Firm* — Greenberg Traurig, LLP

(57) ABSTRACT

A convertible clutch purse is disclosed that converts to a billowy sash and vice versa. The purse is formed of an elongated composite fabric structure having an inner sheet and an outer billowed sheet attached together to form, in one embodiment, a generally oval shaped body. A selectively closable pocket is sandwiched between the inner and outer sheets, wherein the pocket is accessible along one edge joining the inner and outer sheets, and wherein the sash may be folded into the pocket to convert the sash into the clutch purse. An alternative embodiment converts from the purse to a stole or scarf having free ends.

4 Claims, 6 Drawing Sheets

(56) References Cited

U.S. PATENT DOCUMENTS

| | | | | |
|---|---|---|---|---|
| D432,301 | S | 10/2000 | Vazquez | |
| D468,904 | S | 1/2003 | Vazquez | |
| D469,251 | S | 1/2003 | Vazquez | |
| D469,604 | S | 2/2003 | Vazquez | |
| 6,595,396 | B2 | 7/2003 | Cummings et al. | |
| 6,634,041 | B2 | 10/2003 | Higashi et al. | |
| 6,644,527 | B1 | 11/2003 | Karenga | |
| 6,886,726 | B1 | 5/2005 | O'Hare | |
| D505,787 | S | 6/2005 | Vaughn | |
| 7,143,450 | B2 * | 12/2006 | Green, III | 2/94 |
| 7,269,855 | B2 * | 9/2007 | LaRocco | 2/49.1 |
| 7,870,982 | B2 | 1/2011 | Dong et al. | |
| 2005/0039242 | A1 | 2/2005 | Edmondson | |
| 2006/0157525 | A1 | 7/2006 | Furlong et al. | |
| 2010/0237121 | A1 | 9/2010 | Stein | |

* cited by examiner

CONVERTIBLE CLUTCH PURSE

CROSS REFERENCE TO RELATED APPLICATIONS

This application claims the benefit of priority of U.S. Provisional Patent Application Ser. No. 61/573,315, filed Sep. 2, 2011, entitled Pocket(s) Bandolier Convertible into Clutch-Purse and/or Belt-Carrier, and Provisional Patent Application Ser. No. 61/567,473, filed Dec. 6, 2011, entitled Convertible Scarf, the content of which are hereby incorporated by reference in their entirety.

BACKGROUND OF THE DISCLOSURE

U.S. Pat. Nos. 4,634,031 and D505787 disclose typical over-the-shoulder pocket bandoliers. People, particularly women, often select their purses and/or scarves in a manner to complement their clothing. However, over the shoulder pocket bandoliers such as shown in these patents, are not constructed or designed as a garment to complement a wearer's outfit or make a complementary fashion statement. A sash, on the other hand, is often used to complement a wearer's outfit. Most women, for example if using such a garment as a bandolier or sash, would still opt, in addition, for carrying a clutch purse or a strapped purse over one shoulder in a normal manner. In such a case, one often will lay her purse down when handling merchandise, for example, which can lead to inadvertent misplacement or theft of one's purse. Therefore there is a need for a product that can carry normal purse items so as to circumvent such problems, and still look like part of the persons collective outfit.

SUMMARY OF THE DISCLOSURE

The present disclosure directly addresses this problem. A convertible sash in accordance with a first embodiment of the present disclosure provides a decorative billowing bandolier or sash that looks like a decorative billowing wrap, shawl or sash, but has, within its folds, a closable pocket into which personal items such as lipstick, wallet, comb can be stored while still retaining its draped, billowy shape when worn. In addition, when the pocket is turned inside out, the billowy sash can be stuffed into this pocket to convert it into a clutch purse. The pocket is of sufficient size to carry the typical content of a clutch purse in addition to the sash.

Another embodiment may further include a set of tails attached to the side edges of the clutch purse that can be either tied or snap fastened together to make the clutch purse into a waist pack.

A still further embodiment is a scarf or stole, that includes a pocket into which, when turned inside out, the scarf or stole can be stuffed to convert the scarf into a clutch purse.

Further features, advantages and characteristics of the embodiments of this disclosure will be apparent from reading the following detailed description when taken in conjunction with the drawing figures.

DETAILED DESCRIPTION

Figure 1:
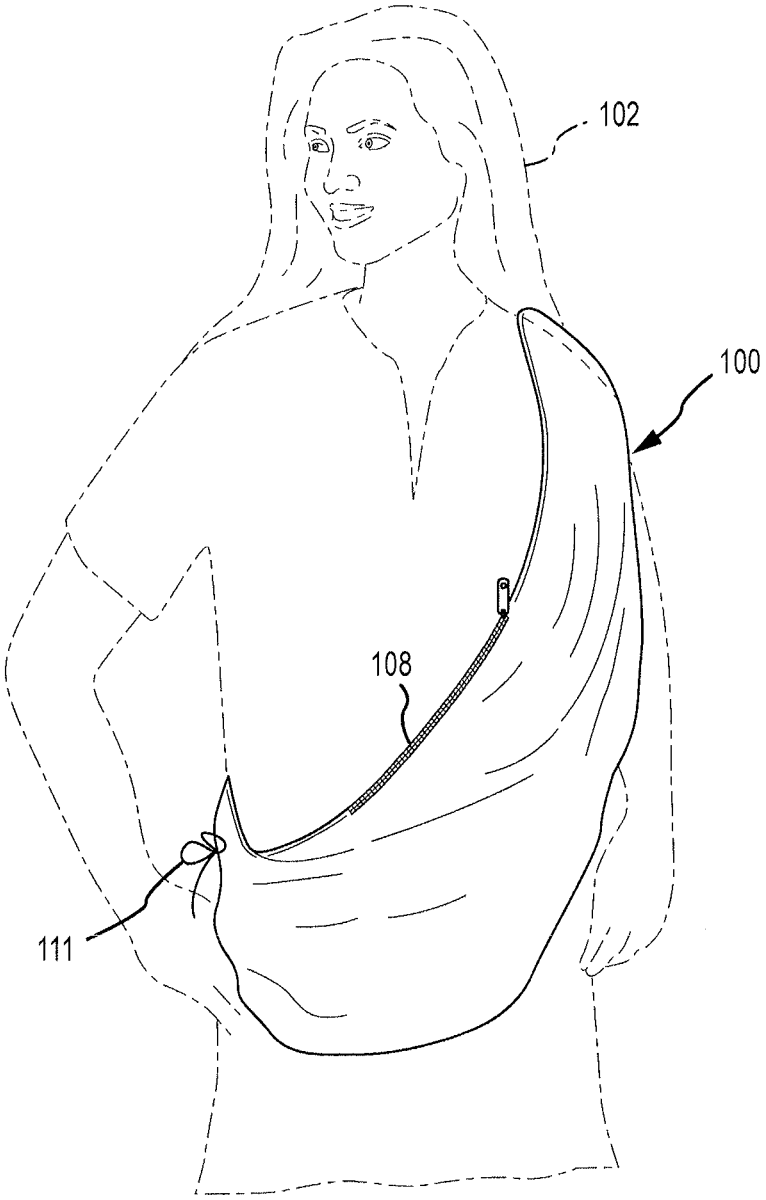
FIG. 1 is a perspective view of a person wearing a billowing sash in accordance with an exemplary embodiment of the present disclosure.
Figure 2:
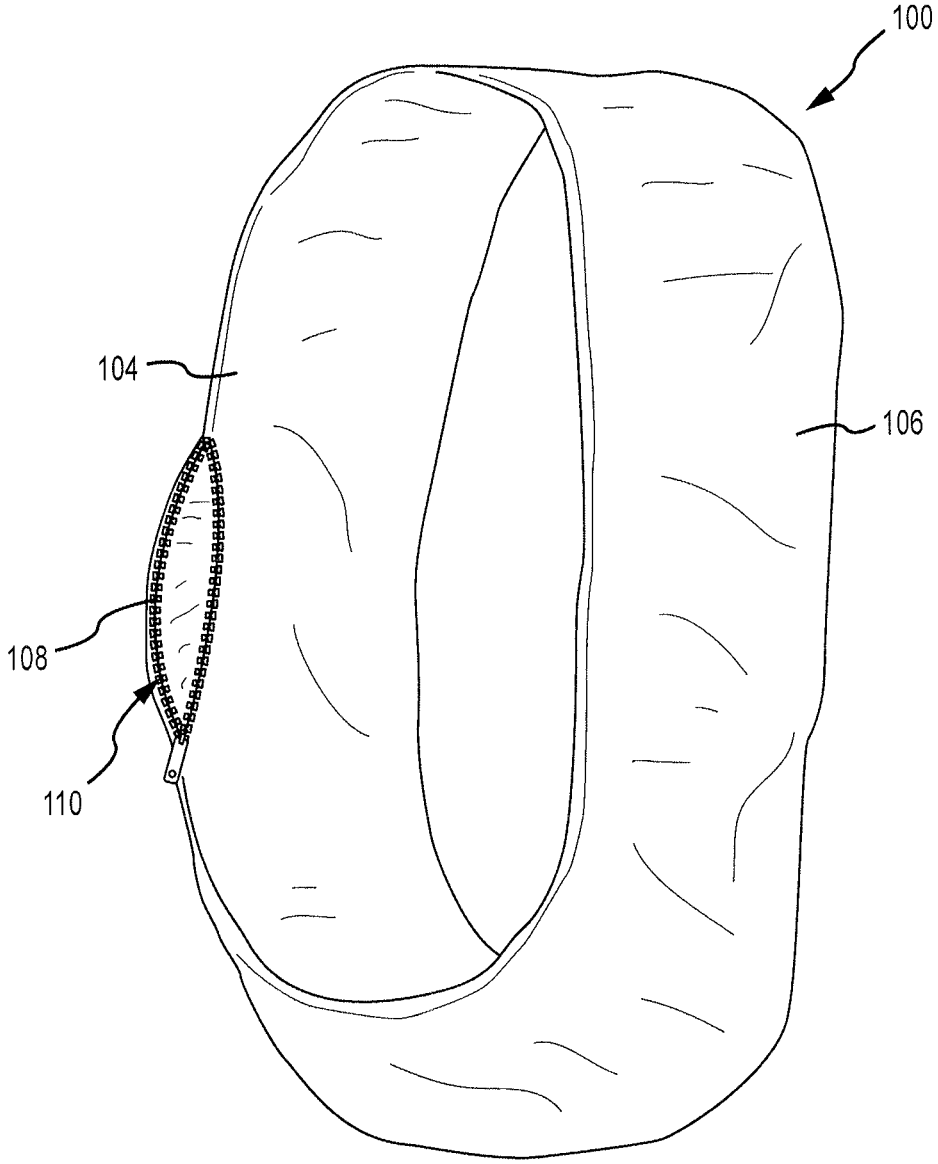
FIG. 2 is separate perspective view of the billowing sash shown in FIG. 1.

An exemplary embodiment of a convertible sash/clutch purse 100 is shown in FIG. 1 worn by a woman 102. The convertible sash/clutch purse 100 is separately shown in FIGS. 2-4. The sash 100 is an elongated body having a continuous general oval shape, formed from two sheets preferably sewn together. The sash 100 has a fabric inner sheet 104 that forms a generally body hugging sash. This inner sheet 104 is sewn or otherwise fastened along its outer edges to a loosely billowed outer fabric sheet 106. Along a portion of an upper edge of the inner sheet 104 one side of a zipper 108 is sewn. The zipper 108 is also sewn to one edge of a generally rectangular pocket 110. The other side of the zipper 108 is sewn to an upper edge of the billowy outer fabric sheet 106 so as to sandwich the pocket 110 between the inner sheet 104 and the outer sheet 106.

The inner sheet 104 may be formed of any fabric material. A smooth fabric such as satin or silk may be preferred so as to ride comfortably against the wearer's clothing. The outer sheet 106 may be any one of a number of decorative fabrics that is chosen to complement a portion of the person's clothing such as blouse, skirt or pants, and may be fine woven or coarse, and may be patterned or plain. The outer sheet 106 is preferably larger than the inner sheet 104 such that when sewn together, the outer sheet 106 billows and drapes loosely on the wearer 102 about the inner sheet 104 forming the sash 100. Such a construction also hides the pocket 110 when worn, as the pocket 110 typically may contain numerous items that the wearer normally would carry in a separate purse.

Because of the billowy nature of the outer sheet 106, a drawstring 111 may also be provided around the perimeter so that the wearer can adjust the amount of billow that the sash 100 presents when worn. A second or third smaller pocket (not shown) could also be provided in the sash 100 for storage of particularly vital small items such as extra cash or keys.

Figure 3:
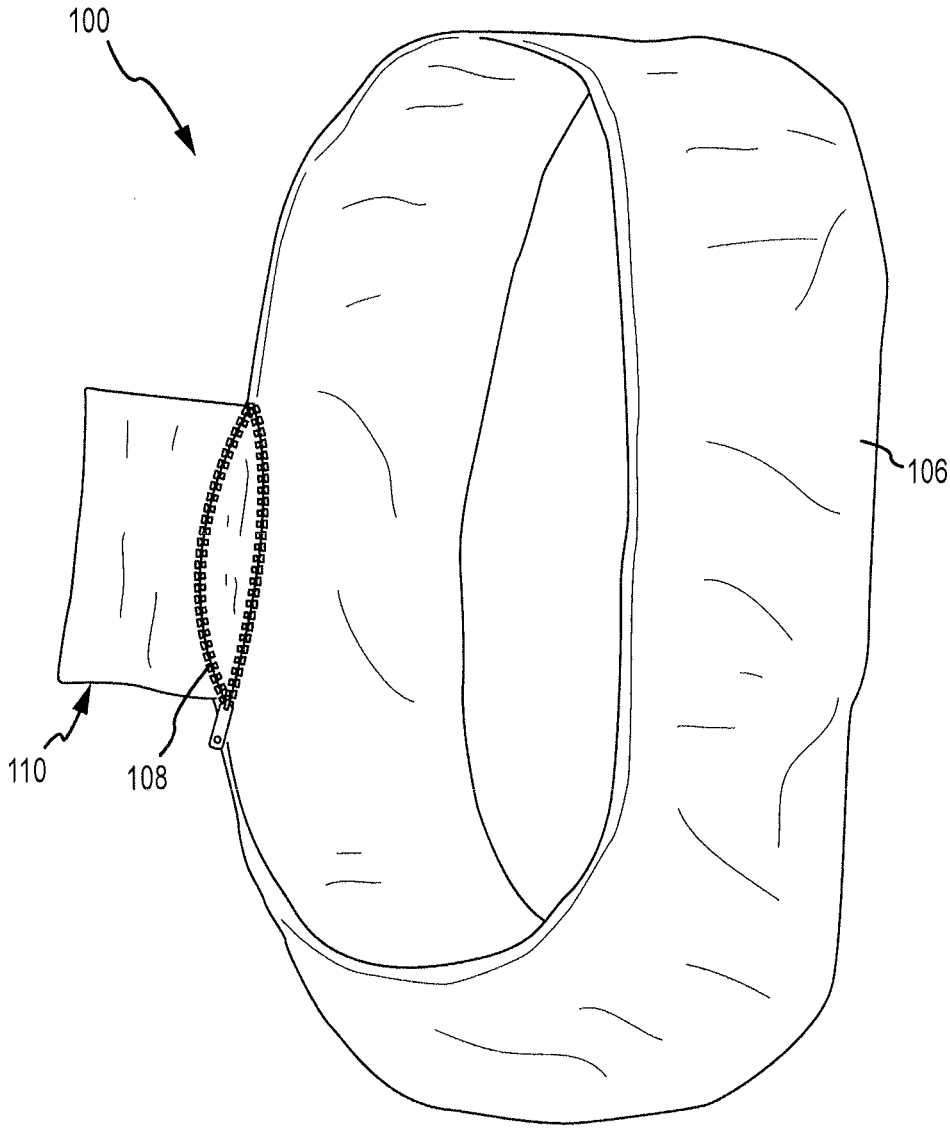
FIG. 3 is a separate perspective view of the billowing sash shown in FIG. 2 with the pocket turned inside out.
Figure 4:
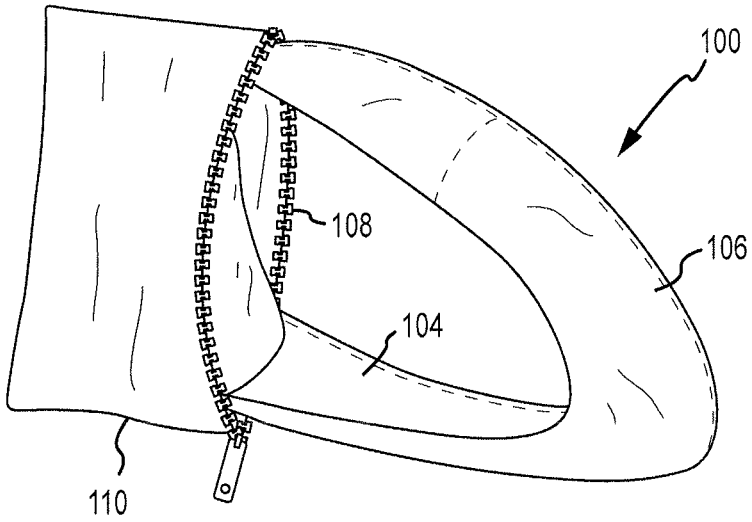
FIG. 4 is a separate perspective view of the sash partially folded into the pocket to form the clutch purse.
Figure 6:
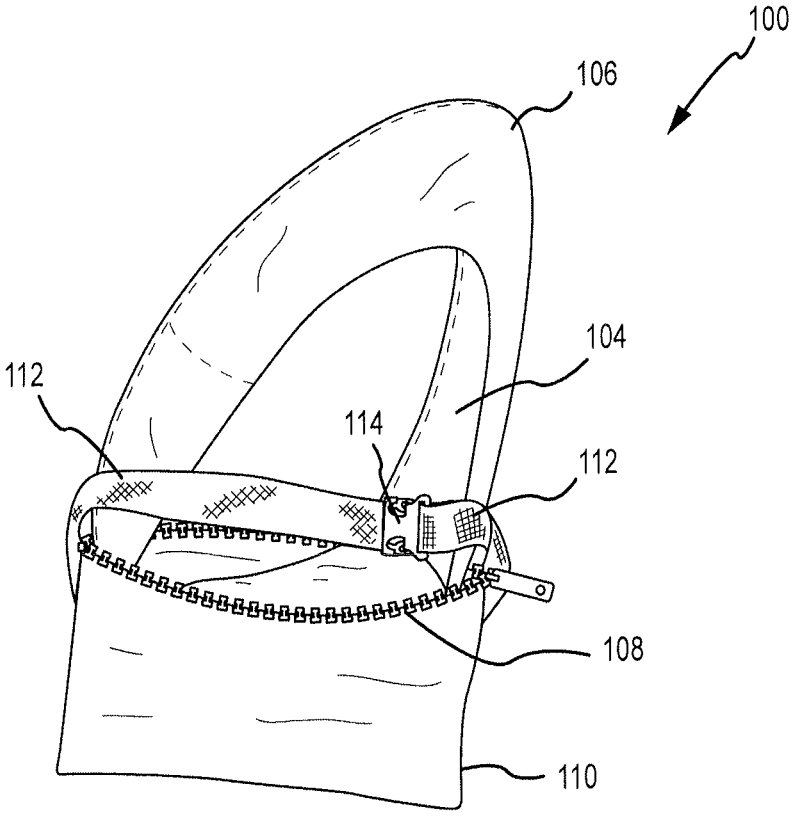
FIG. 6 is a perspective view of either the billowy sash or convertible scarf partially folded into the clutch purse with tails to form a waist pack in accordance with the present disclosure.

The sash 100 is preferably worn as shown in FIG. 1. The wearer 102 can also take off the sash 100 and open the zipper 108, pull inside-out the pocket 110, as shown in FIG. 3, and then stuff the sash 100 into the pocket 110 as is shown in FIG. 4. The pocket 110 then becomes the clutch purse. Alternatively, the pocket 110 may have tails or belt straps 112 sewn or removably attached to its lateral outer edges, as shown in FIG. 6. These belt straps 112 preferably terminate in male/female mating buckles 114 such that the clutch purse (converted sash 100) alternatively can be worn as a waist pack. These straps 112 may, for example, be fastened to the pocket 110 via snap fasteners, or sewn to the pocket 110.

Figure 5:
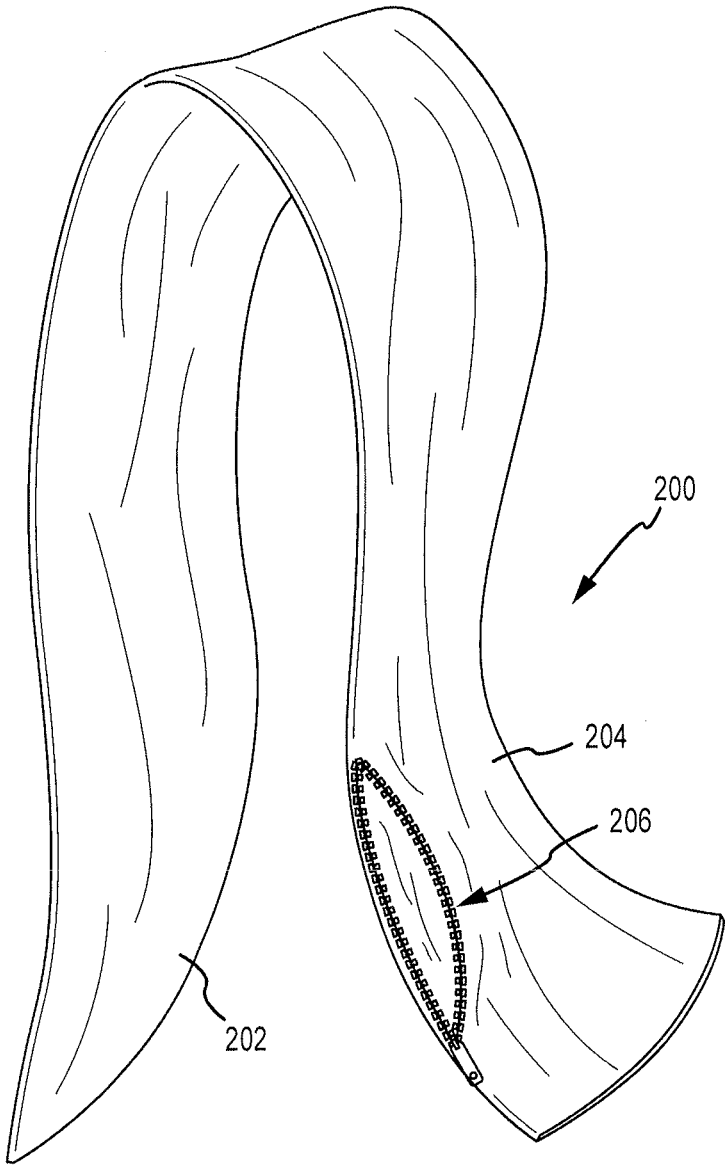
FIG. 5 is a perspective view of a convertible scarf in accordance with another embodiment of the present disclosure.

An alternative convertible scarf or stole 200 is shown in FIG. 5. Here the convertible scarf or stole 200 is formed in the same manner as the sash 100 except that the ends of the fabric sheets are not joined a continuous loop or sash. The scarf or stole 200 is formed of an inner sheet 202 sewn to an outer sheet 204 with a zippered pocket 206 that can be utilized identically to that shown and described with reference to the convertible sash 100 above.

There are many alternatives and modifications that will be apparent to those skilled in the art. For example, the scarf or stole 200 may be configured by another zipper along its bottom ends such that the ends may be joined together to form a virtual equivalent to the sash 100 described above. The sash 100 may be configured with zippered pockets 110 on both sides of the sash 100 in a mirror configuration. The sash 100 may also include a short sleeve portion for the upper arm of the wearer such that it will not slip down off the wearer's shoulder when worn during exercise. All such changes, alternatives and equivalents in accordance with the features and benefits described herein, are within the scope of the present disclosure. Such changes and alternatives may be introduced without departing from the spirit and broad scope of my invention as defined by the claims below and their equivalents.

What is claimed is:

1. A convertible sash/clutch purse comprising:

an elongated composite fabric structure having an inner sheet and an outer loosely billowed annular sheet attached together to form a continuous generally oval ring shaped body;

a selectively closable pocket separate from and attached to the inner and outer sheets and sandwiched between the inner and outer sheets, wherein the pocket is accessible along one edge joining the inner and outer sheets, and wherein the sash may be folded into the pocket to convert the sash into the clutch purse, wherein the loosely billowed outer sheet of the sash loosely drapes on a wearer and substantially hides content of the pocket when worn as a sash; and a drawstring around the ring shaped body to adjust an amount of billow of the loosely billowed sheet.

2. The purse according to claim 1 wherein the closable pocket includes a zipper closure along a seam between the inner and outer sheets.

3. The purse according to claim 2 further comprising a strap extending from each opposite side of the pocket configured to convert the purse to a waist pack.

4. The purse according to claim 1 wherein the elongated body forms a continuous sash for a person to wear between hip and opposite shoulder.

* * * * *

UNITED STATES PATENT AND TRADEMARK OFFICE

CERTIFICATE OF CORRECTION

PATENT NO. : 8,944,682 B2
APPLICATION NO. : 13/368523
DATED : February 3, 2015
INVENTOR(S) : Lee It is certified that error appears in the above-identified patent and that said Letters Patent is hereby corrected as shown below:

In the Claims

In Column 3, Line 18, in Claim 1, delete "fabric structure having an inner" and insert -- fabric sash having an inner annuler --, therefor.

In Column 4, Line 6, in Claim 1, delete "into the" and insert -- into a --, therefor.

Signed and Sealed this
Eighth Day of September, 2015

Michelle K. Lee

Michelle K. Lee
*Director of the United States Patent and Trademark Office*